US005609120A

United States Patent [19]

Eronen

[11] Patent Number: 5,609,120

[45] Date of Patent: Mar. 11, 1997

[54] TRACTION ARRANGEMENT FOR A TUG BOAT

[75] Inventor: Harri K. Eronen, Raisio, Finland

[73] Assignee: Aquamaster-Rauma Ltd., Rauma, Finland

[21] Appl. No.: 403,680

[22] Filed: Mar. 14, 1995

[30] Foreign Application Priority Data

Mar. 14, 1994 [FI] Finland ..... 941195

[51] Int. Cl.[6] ..... B63B 21/04

[52] U.S. Cl. ..... 114/253; 114/254

[58] Field of Search ..... 114/56, 57, 140, 114/141, 142, 242, 253, 254

[56] References Cited

U.S. PATENT DOCUMENTS

| | | | |
|---|---|---|---|
| 1,621,168 | 3/1927 | Kluver | 114/235 |
| 3,890,918 | 6/1975 | Sell | 114/253 |
| 3,892,386 | 7/1975 | Hogan | 254/190 R |
| 3,987,746 | 10/1976 | McCulloh | 114/254 |
| 4,175,511 | 11/1979 | Krautkremer | 115/35 |
| 4,213,413 | 7/1980 | Courtney | 114/253 |
| 4,960,065 | 10/1990 | Junkeris | 114/254 |

FOREIGN PATENT DOCUMENTS

| | | |
|---|---|---|
| 0174067 | 3/1986 | European Pat. Off. . |
| 0176189 | 4/1986 | European Pat. Off. . |
| 63549 | 6/1978 | Finland . |
| 852977 | 2/1986 | Finland . |
| 1756005 | 3/1970 | Germany . |
| 2453422 | 5/1976 | Germany . |
| 1025580 | 6/1983 | U.S.S.R. . |
| 1398382 | 6/1975 | United Kingdom . |

*Primary Examiner*—Stephen Avila

*Attorney, Agent, or Firm*—Steinberg, Raskin & Davidson, P.C.

[57] ABSTRACT

A traction arrangement for a tug boat having a towing winch mounted on the aft and/or fore deck and a tow rope connected to the winch and connectable to a vessel being assisted for necessary measures, such as towing, arresting, steering and equivalent. In order to enhance the stability of the tug boat and the towing, steering, arresting and equivalent properties achieved with the tug boat for the vessel to be assisted, the traction arrangement includes a tow arc mounted essentially in a plane of the deck within an area defined with a transverse bulwark in the front part of the front deck of the tug boat or in the rear part of the aft deck. To be mobile along the tow arc, a towing eyelet is arranged, and through which the tow rope from the towing winch passes to the vessel to be assisted. Traction power is transmitted to the tug boat, and which towing eyelet is on each occasion arranged to be positioned according to the towing angle.

17 Claims, 9 Drawing Sheets

Fig. 3E
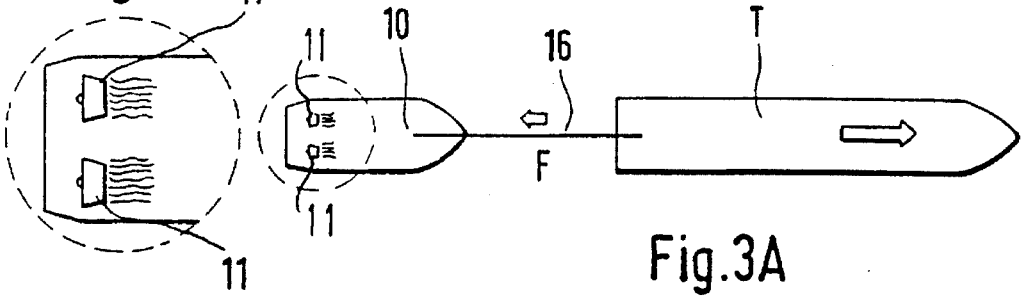
Fig.3A
Fig. 3F
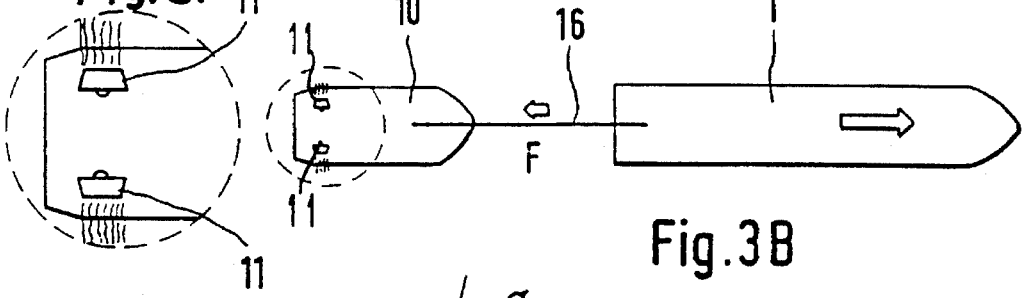
Fig.3B
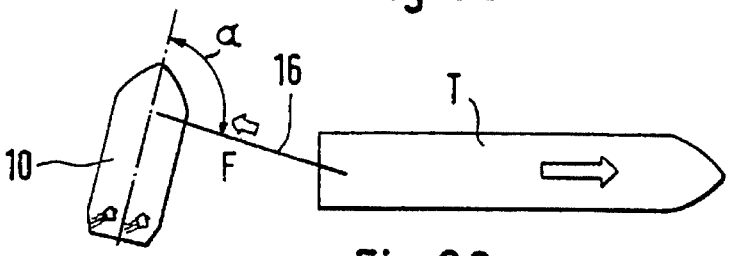
Fig.3C
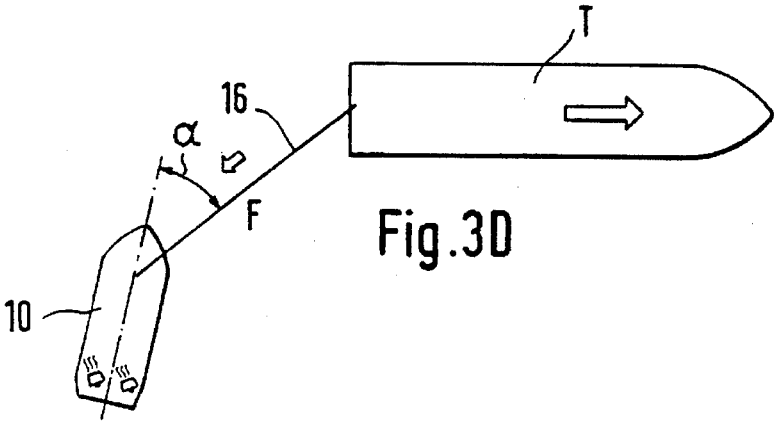
Fig.3D

TRACTION ARRANGEMENT FOR A TUG BOAT

BACKGROUND OF THE INVENTION

The present invention relates to a traction arrangement for a tug boat having a towing winch installed on the aft deck and/or the forecastle. At ow rope, wire or equivalent is emitted from the winch and is connected to a vessel in order to provide assistance for requisite measures, such as towing, arresting, steering, and equivalent.

Accidents have occurred in the immediate past, which may even have lead to major oil damages, which accelerated pressure toward improvements in safety in marine oil transports. Some of the accidents lead to oil damage which resulted from an oil tanker that lost either its steerability or propulsive thrust at a critical moment. As a consequence of such oil accidents, the requirements concerning tanker structures have been tightened, inter alia, so that a double bottom structure is required to be built in tankers. In addition, development of tug boats of a novel type has been necessary to provide assistance to and escort tankers in dangerous and coastal waters, i.e., outside of safe harbors.

Totally different standards are set for such, so-called escort tug boats compared with conventional harbor tug boats. First, the escorting speed of an escort tug boat is required to be at least as high as the lowest operating speed of a tanker. The most economical escorting speed is the highest permitted operating speed for tankers in a certain area, or, if no such limitations exist, the highest permitted speed at which the trafficking is safe. In practice, this means that the escorting speed can be even 13 to 14 knots. Accordingly, the tug boat is at this speed required to be able to carry out its escorting tasks as well as merely following the tanker at this speed. Furthermore, the escort tug boat should be able to function in all weather conditions. Such prerequisites mandate that an escort tug boat must be able to function in all conceivable directions and that it has to be able, whenever needed, to change the direction at maximum speed. Furthermore, an escort tug boat like this is required to possess maximum traction power. In view of such requirements, the only useful propulsion apparatus in current escort tug boats is, in fact, a propeller means capable of turning around 360° and possessing a great propulsive thrust.

Primarily two types of tug boats appropriate for escort towing are known in the art, one of them being a so-called tractor tug boat in which the towing winch is positioned on the aft deck and in which the propeller means have been disposed on the front side to the towing winch, closer to the bow of the vessel. The other type is a so-called stern drive tug boat in which the towing winch is placed on the fore deck and in which the propeller means have been arranged in the stern of the vessel. The tractor tug boats and escort stern drive tug boats thus represent the state of art technology. A drawback particularly related to the stern drive tug boats is that although the lateral surface area of the hull thereof is rather large, it is not advantageous as far as its shape is concerned and the point of application of the force is located too far back so that transverse forces are difficult to achieve.

In ordinary tug boats, which are mainly intended for towing only and not for arresting, an arcuate construction provided with a hook is generally arranged on the aft deck of the tug boat to which hook, the tow rope is fastened. This construction has been found to increase the stability of the tug boat. On the forecastle of tug boats intended for arresting, no such constructions have been used.

On the other hand, a box keel or plate keel has frequently been used to improve the direction stability in ordinary vessels, but not in tug boats.

OBJECTS AND SUMMARY OF THE INVENTION

Accordingly, it is an object of the present invention to provide a novel traction arrangement for tug boats, whereby an improvement is achieved compared with the existing designs.

For implementing this object, in the invention, for improving the stability of the tug boat and the towing, steering, arresting and equivalent properties to be provided by a tug boat to a vessel to be assisted, the traction arrangement comprises a towing arc mounted substantially in the plane of the deck within an area defined by a transverse bulwark in the front part of the forecastle of the tug boat and in the rear part of the aft deck, along which arc, a displaceable towing eyelet is arranged. Through the eyelet, the tow rope from the towing winch passes to the vessel to be assisted, and traction power is transmitted to the tug boat. The towing eyelet is arranged to be positioned dependent on the towing angle.

Briefly, the traction arrangement for a tug boat in accordance with the invention in applied in a tug boat having a towing winch arranged on one of its decks and a tow rope or towing wire connected to the towing winch and connectable to a vessel to be assisted by the tug boat. The arrangement comprise a tow arc mounted on the deck, and a towing eyelet movable along the towing arc. The tow rope is passed from the towing winch through the towing eyelet to the vessel being assisted. The towing eyelet is movable along the towing arc to different angular positions in relation to a towing angle defined between a longitudinal center line of the boat and a direction of the tow rope extending from the boat to the vessel. The towing winch may be arranged on an aft deck of the boat whereby the tow arc is situated in a stern part of the aft deck or when the towing winch is arranged on a fore deck of the boat before a forecastle, the tow arc is situated in front of the forecastle. Preferably, the tow arc is substantially arcuate and comprises a tubular or rail construction and the towing eyelet is arranged in a slide or sledge engaging with and movable along the tubular or rail construction.

In a tug boat wherein the towing winch is mounted on a forecastle of the tug boat behind a transverse bulwark or in front of the transverse bulwark on the aft deck, the arrangement may include a steering runner through which the tow rope or towing wire pass from the towing winch to the towing eyelet. The steering runner is arranged substantially within an area of a centerpoint of the tow arc. In addition, the tow arc may be positioned in a region defined between a bulwark of the boat and an end of the boat to which the bulwark does not extend.

With the invention, remarkable benefits are gained in comparison with designs known in the art. Of such benefits, for instance, it should be mentioned that in the tug boat, the traction point of a first traction rope of the winch wire is arranged to be mobile so that the traction point is always at an optimal point regarding the stability of the tug boat. A second significant advantage lies in that fact that the side projection of the underwater part of the tug boat is formed and made quite large that the tug boat is capable of receiving extremely powerful forces. Furthermore, the side projection of the underwater part of the vessel is in such shape that the pressure centerpoint of the projection can be arranged to be at an optimal point relative to the traction point of the winch.

Other advantages and characteristic features of the invention will be apparent from the detailed description of the invention.

BRIEF DESCRIPTION OF THE DRAWINGS

The following drawings are illustrative of embodiments of the invention and are not meant to limit the scope of the invention as encompassed by the claims.

FIGS. 3A, 3B, 3C, 3D, 3E and 3F show various modes of operation of a tug boat.

FIG. 6 shows a side view a part of a tug boat provided with an advantageous embodiment of the traction arrangement in accordance with the invention.

FIG. 7 shows a top view of the part of a tug boat provided with an advantageous embodiment of the traction arrangement as shown in FIG. 6.

DETAILED DESCRIPTION OF THE INVENTION

Figure 1:
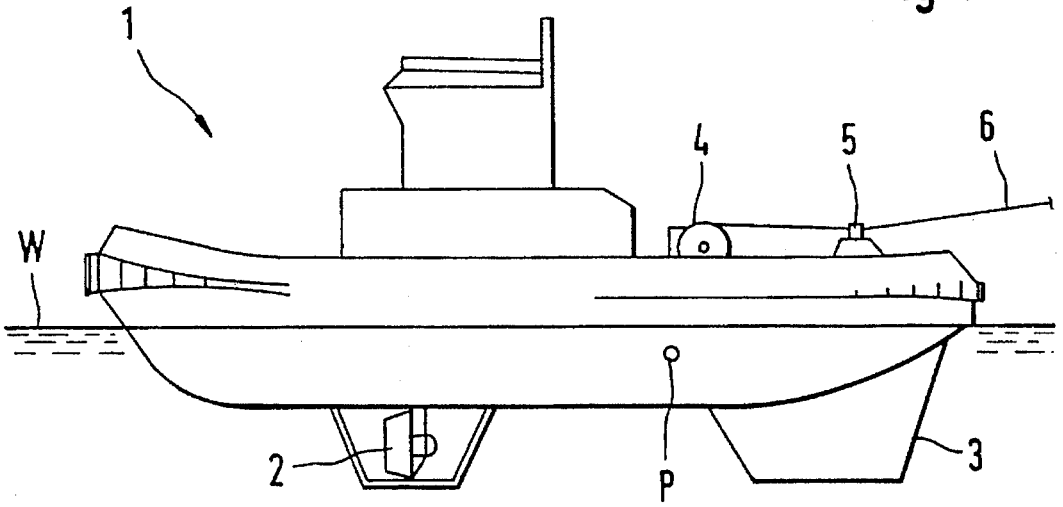
FIG. 1 shows an elevational view of a tractor tug boat.

In the schematical elevational view presented in FIG. 1, a tractor tug boat is in general indicated by reference numeral 1. As shown in FIG. 1, propeller means 2 are positioned closer to the bow of the boat than the aft in the tug boat 1, but however, in front of a traction point 5 of a towing winch 4. A tow rope or wire is in FIG. 1 indicated by reference numeral 6 and is connected to the winch 4. In the stern of the tug boat (rear part), a large stern fin 3 is installed below the water surface W, the purpose thereof being to increase the side projection of the underwater hull profile of the tug boat to the extent that the tug boat 1 is able to receive greater forces laterally. The purpose of the stern fin is also to improve the directional stability. In FIG. 1, the hydrodynamic point of application of the side projection is indicated by reference P. The location of the hydrodynamic point of application P is of essential importance to the traction power of the tug boat 1 and the receptivity of such forces. With regard to the traction power and the receptivity of the forces, the most important factors are the longitudinal and height-directional distance of the propeller means 2 from the traction point 5, as well as the longitudinal and height-directional distance of the hydrodynamic point of application P from the traction point 5. These dimensions are of uttermost importance considering the traction power and the stability of the tug boat.

Figure 2:
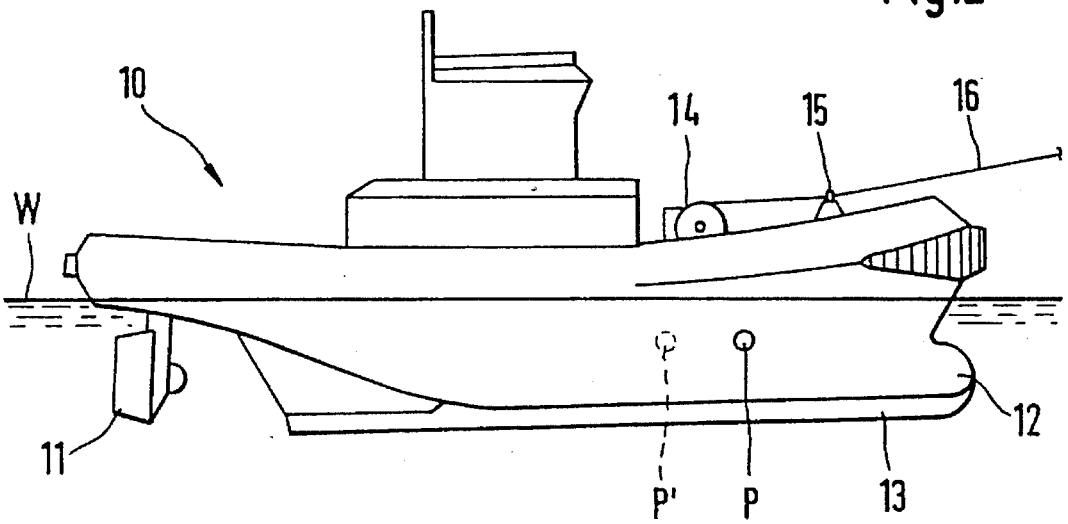
FIG. 2 shows an elevational view of a stern drive tug boat of the invention.

FIG. 2 presents as a schematical elevational view a stern drive tug boat, generally indicated by reference numeral 10. In the stern drive tug boat 10, propeller means 11 are provided, positioned in the stern of the tug boat while a towing winch 14 is located on the forecastle of the tug boat. The traction point is indicated by reference numeral 15 and a tow rope or wire 16 is connected to the towing winch 14. In tug boat 10 as shown in FIG. 2, the transverse projection of the underwater hull profile of the tug boat is formed to be quite large since the tug boat 10 is provided with a bow bulging 12. Furthermore, an additional keel is mounted under the bottom of the vessel, such as box keel 13, plate keel or equivalent, which further increases the transverse projection of the hull profile. As a result of the bow bulging 12, the hydrodynamic point of application P of the side profile can be shifted forward, closer to the traction point 15. Reference P' shows the point where the hydrodynamic point of application is located without a bow bulging 12. The surface of the water is indicated by reference W in FIG. 2.

It is noteworthy to point out that the locations of the hydrodynamic points of application P,P' shown in FIGS. 1 and 2 are not constant but rather shift in the longitudinal direction of the vessel, depending on the angle of the flow entry. Typically, the hydrodynamic point of application P is located in a tractor tug boat 1, as shown in FIG. 1, between the midway and the stern of the vessel and in a stern drive tug boat 10 as shown in FIG. 2, between the midway and the bow point of the vessel. The points in the figures are presented merely by way of example.

FIGS. 3A and 3B present various modes of operation in which the tug boat 10 of the invention is used for escort towing. FIGS. 3A and 3B present the primary modes of operation in which the propagation of a tanker T is arrested with a tug boat 10 and, if need be, stopped. FIGS. 3E and 3F are enlarged views of the encircled areas in FIGS. 3A and 3B, respectively. FIG. 3A shows a situation in which the propeller means 11 of the tug boat 10 are so directed that the propulsive thrust provided thereby is in the direction of propagation. In this mode of operation, the tug boat 10 is kept in the same direction as the tow rope 16. The traction F is thus created solely with the aid of the propeller means 11. In this mode of operation the traction power F is dependent on the speed of the tanker T. The highest traction power achieved in the tests was about 1.5 to 1.6 times the static traction power of the tug boat. However, as mentioned above, this mode of operation cannot be used at very high speeds because when the traction power is provided solely with the aid of the propellers, the engine of the tug boat 10 will be excessively overloaded when the speed of the tanker T becomes high enough. If such excessive overloading occurs, the tug boat 10 has to be turned from the position shown in FIG. 3A.

FIG. 3B presents a second mode of operation in which the tug boat 10 is used also for direct arresting and holding of the tanker T. This mode of operation differs from the one shown in FIG. 3A in that the propeller means 11 are turned 90° relative to the travelling direction of the tug boat 10 so that the propeller means 11 face each other. When the engines are in this mode of operation running idle, the arresting effect provided by the tug boat 10 is insignificant. However, when the engines of the tug boat 10 are run at full speed, the arresting effect is, even at a very low speed (about 8 knots), equal to the highest static traction power obtainable with the tug boat 10. This has been proved in the tests results of the invention. However, when the speed increases, the arresting effect also increases substantially linearly. There is no similar risk when using this mode of operation to overload the engines compared with the mode of operation shown in FIG. 3A. Consequently, the mode of operation shown in FIG. 3B can be used effectively at high speeds. A second remarkable advantage achieved with this mode of operation is that hardly any side thrust component is created in the tug boat 10, so that the arresting will not interfere with the steering of the vessel being assisted, that is, the tanker T.

FIG. 3C illustrates a mode of operation in which the tug boat 10 has been turned mainly in transverse direction to the tow rope 16. This mode of operation is a so-called dynamic mode of operation, and therewith, an excellent and powerful arresting and steering effect is provided, particularly if the side projection of the underwater hull profile of the tug boat is sufficient. Therein, the arresting effect is provided particularly with the aid of the hull of the tug boat 10. It is especially important in this mode of operation that the stability of the tug boat is of great importance because, if the location of the traction point of the tug boat 10 relative to the pressure centerpoint of the side projection of the underwater hull profile of the tug boat is poor, the tug boat may even capsize. As mentioned in the foregoing, this mode of operation can be used particularly when steering a tanker T being assisted with the equipment of its own is difficult or impossible, whereby it is with tug boat 10 that the tanker T can be kept in desired direction.

A towing angle $\alpha$ is defined between the longitudinal center line of the boat 10 represented by a dashed line in FIG. 3 and the tow rope 16.

FIG. 3D illustrates a mode of operation which is, in a way, a combination of the modes of operation of direct arresting and of dynamic steering. In this mode of operation, both the hull of the tug boat 10 and the propeller means 11 are used to assist in arresting, and in addition, with the mode of operation, the tanker T being assisted is steered as shown in FIG. 3C. With regard to safety concerns, the mode of operation presented in FIG. 3D is preferred to the design shown in FIG. 3C because the stability of the tug boat in this mode of operation is superior.

As may become obvious in FIGS. 3A–3D, the tug boat is required to be able to provide traction force in a number of different directions relative to the length of the tug boat 10. In addition, as described above, the stability of the tug boat 10 in certain situations, while in operation, is problematic when traction is directed at the tug boat 10 from a difficult direction.

Figure 4:
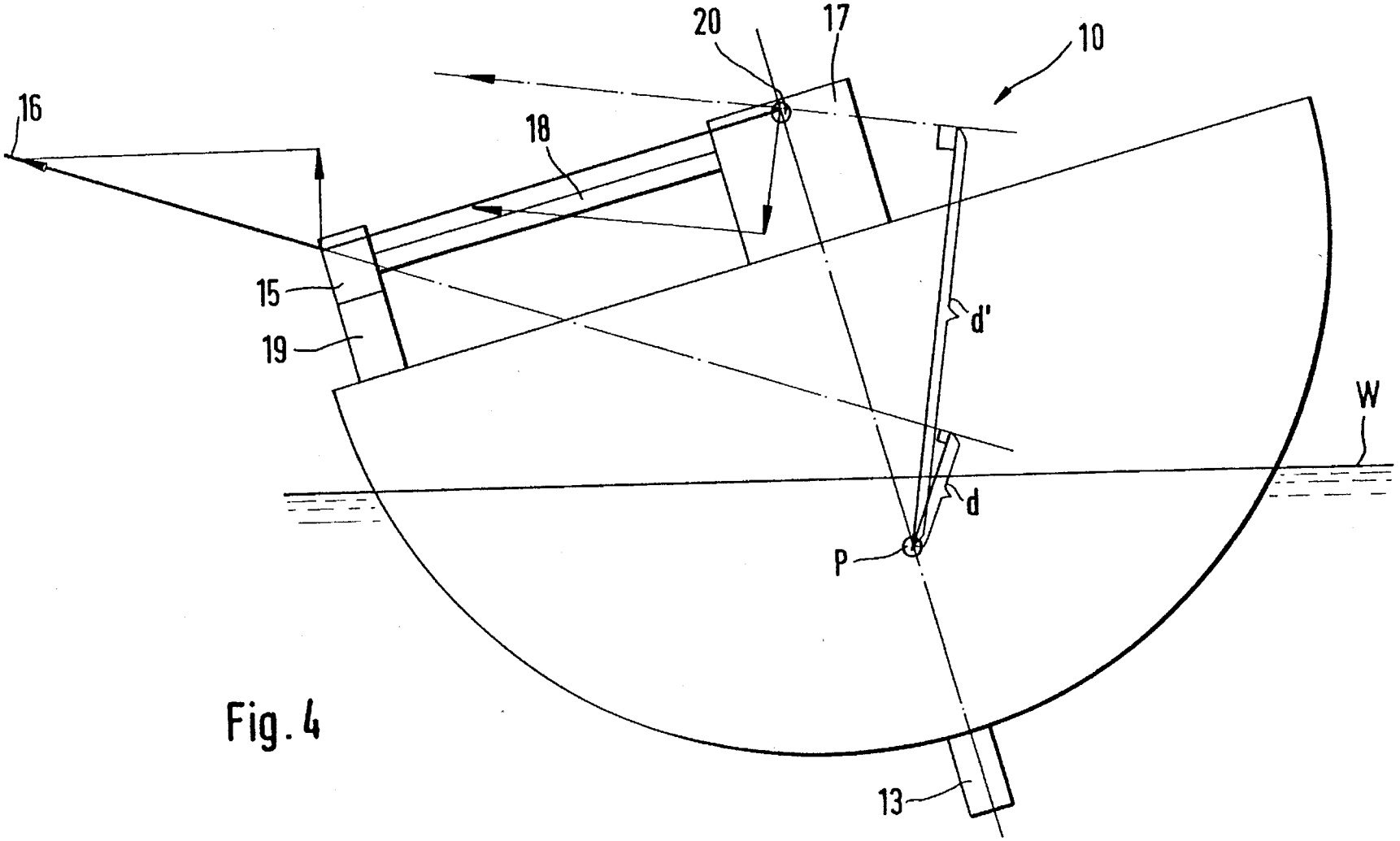
FIG. 4 show a view of a tug boat in a traction situation when viewed in the longitudinal axis direction of the tug boat.
Figure 5:
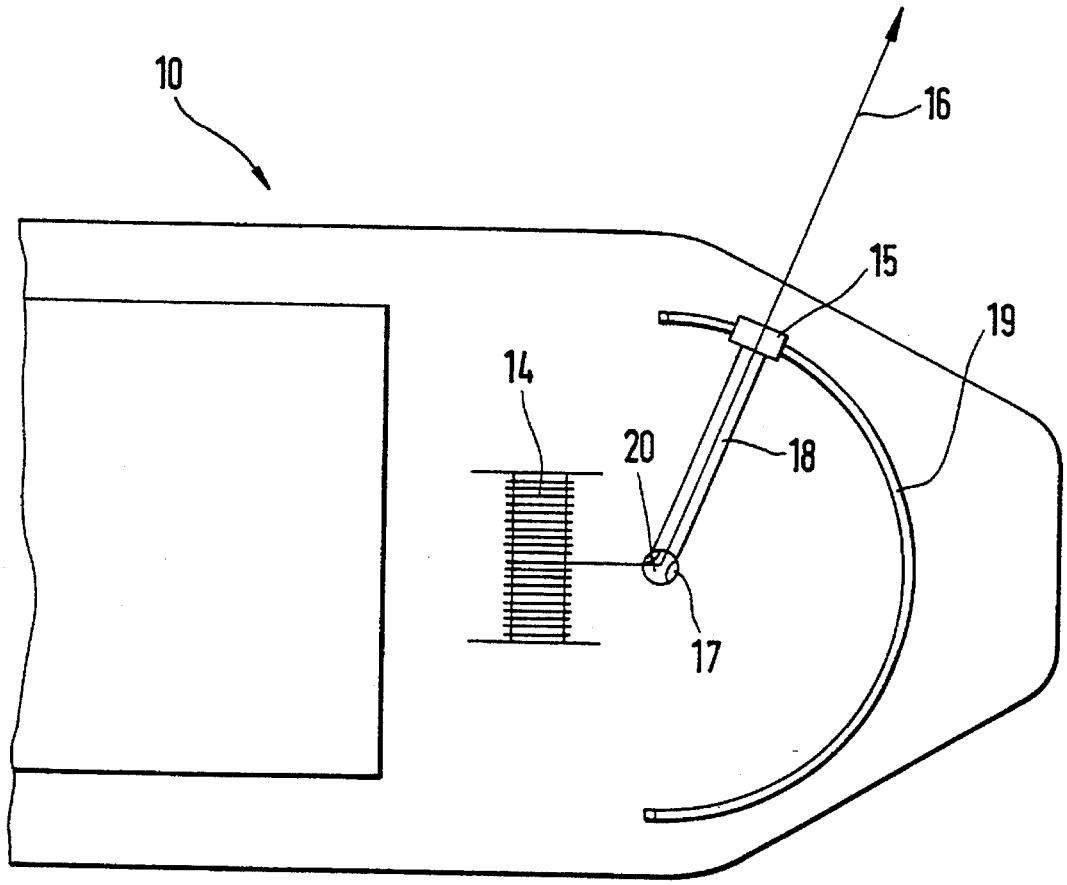
FIG. 5 shows a top view of a traction arrangement of a tug boat in accordance with the invention.

In FIGS. 4 and 5, a design is illustrated by which the stability of the tug boat 10 is improved in difficult situations. FIG. 4 illustrates a tug boat 10 in longitudinal direction and FIG. 5 illustrates tug boat 10 schematically in top view so that in both figures the traction is directed at the tug boat laterally.

As shown in FIGS. 4 and 5, the stability of the tug boat is improved by, on a deck of a tug boat 10 (either on fore deck or aft deck, or even on both decks) mounting a tow arc 19 which is comprised of a tubular or rail structure or equivalent. The tow arc 19 is most advantageously circular in shape, as shown in FIG. 5. On the tow arc 19, a sledge, a slide, or equivalent towing eyelet 15 is positioned to be movable along the tow arc, and through which eyelet 15, a tow rope 16 is arranged to pass so that the towing eyelet 15 creates a traction point from which the tow rope 16 passes to the vessel to be assisted. The tow rope 16 passes from the towing winch 14 into the towing eyelet 15 through a steering runner 20 which is most preferably located in the centerpoint of the tow arc 19 or substantially within the range of the centerpoint. The structure is preferably constructed such that the steering runner 20 is formed in a vertical shaft 17 on which a horizontal beam 18 is mounted and, on the outer end of the horizontal beam 18, the towing eyelet 15 is installed. This will stiffen and stabilize the structure even more. The tow arc 19 is arranged most advantageously in the plane of the deck in that the towing eyelet or loop 15 passes as close to the deck of the tug boat 10 as possible, the purpose thereof being to provide the traction point as low as possible.

The effect and advantage to be gained by means of the structure shown in FIGS. 4 and 5 are most obvious from a view of FIG. 4. As depicted in FIG. 4, the tow rope 16 passes from the towing winch 14 to the towing eyelet 15 either direct or via the steering runner 20. The distance of the line of action of the traction force exerting an influence on the tow rope 16 from the hydrodynamic point of application P of the side projection of the underwater hull profile of the tug boat is indicated by reference d in FIG. 4. Reference d' refers to distance from the hydrodynamic point of application P in an instance in which the traction point of the tow rope would be located in the steering loop 20. The distance d', which constitutes a lever arm to the traction force acting on the tow rope, is considerably greater than distance d, whereby in these two instances, the torque capsizing the tug boat 10 is considerably smaller when using the tow arc 19 of the invention than without any tow arc. If the tug boat 10 heeled further from what is presented in FIG. 4, the line of action of the traction force affecting the tow rope 16 would move even closer to the hydrodynamic point of application P or even to the opposite side thereof. In such case, the traction power would no longer possess the tendency to capsize the tug boat but instead, it would attempt to straighten the tug boat. As discussed above, the design shown in FIGS. 4 and 5 is particularly advantageous, especially in inclined towing situations as shown in FIGS. 3C and 3D.

FIGS. 6 and 7 illustrate an advantageous embodiment of the traction arrangement of the invention, whereby the traction arrangement is positioned on the forecastle of a vessel, i.e., a tug boat 40. As shown in FIGS. 6 and 7, a tow arc 23 is disposed in a front part 30 of the forecastle, this being in its entirety reserved for the tow arc 23 so that no other constructions are arranged within this area. The front part 30 of the forecastle is not provided with any reel, neither is the area intended to be moved upon. By this arrangement, the tow arc 23 can be arranged as low as possible. The arrangement may also be applied on the aft deck of the tug boat in similar fashion.

A bulwark 26 of the vessel 40 terminates in the bow in the rear part of the tow arc 23, and it is drawn transversely in the form of transverse bulwark 27 across the forecastle to define a space for a winch 22 and the rear part of the forecastle.

The tow arc 23 is preferably arranged so that passing a tow rope 21 through the eyelet 24 in the tow arc 23 can be performed without having to cross the transverse bulwark 27 to the front part 30 of the forecastle. The side view shown in FIG. 6 demonstrates that the front part 30 of the forecastle rises towards the bow up so that a freeboard can be added on the bow of the vessel 40. This will not impair the heeling tendency of the vessel 40 because in inclined towing situations, the tow rope 21 is directed to the side in the rear part of the tow arc 23 at point K which is located more below than the bow.

Figure 6A:
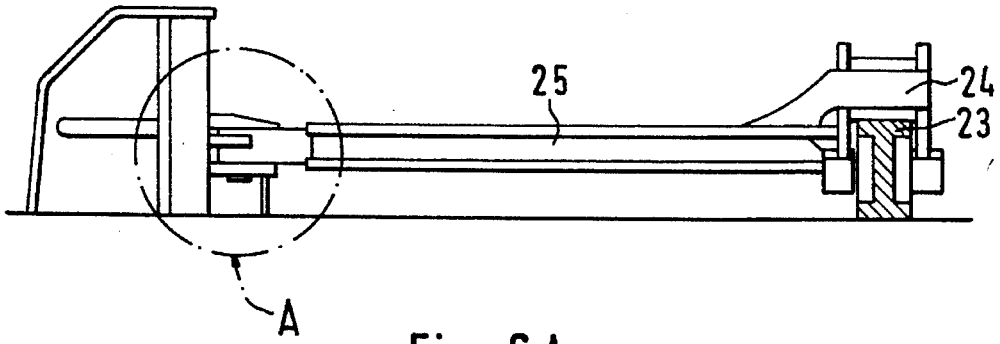
FIG. 6A shows a side view of an embodiment of the traction arrangement in accordance with the invention in which a horizontal beam or equivalent steering rod is used in association with the tow arc.
Figure 7A:
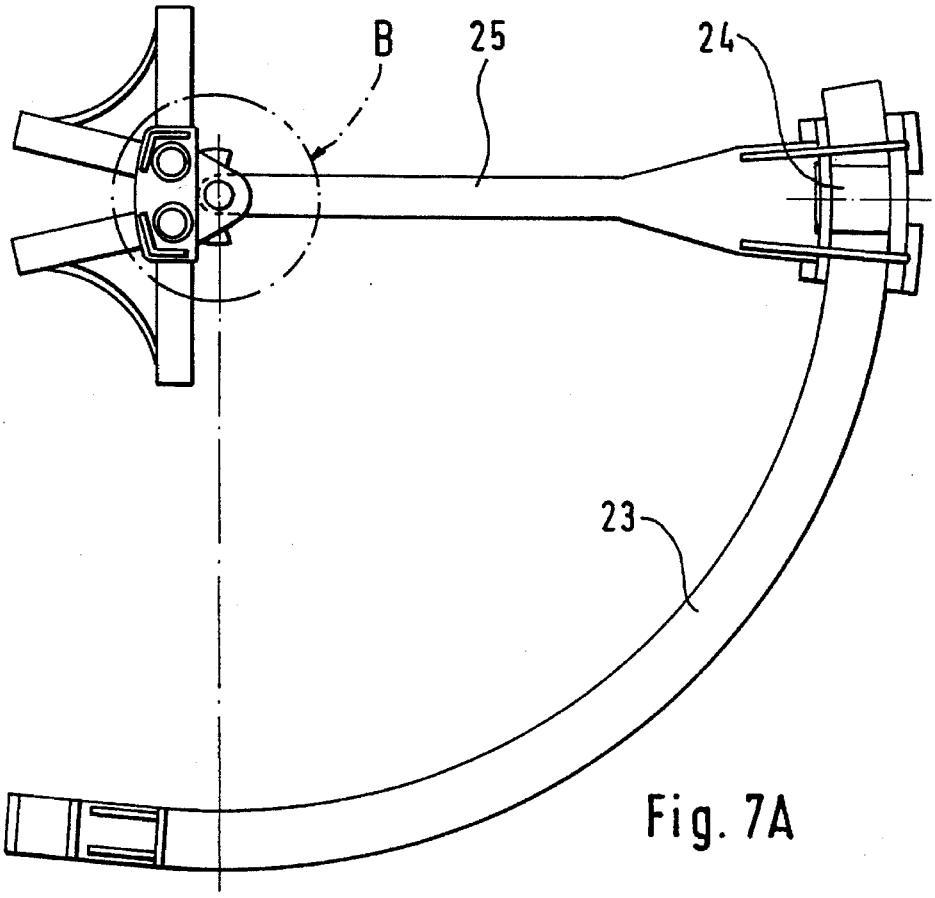
FIG. 7A shows a top view of the embodiment of the traction arrangement in accordance with the invention as shown in FIG. 6A.
Figure 6B:
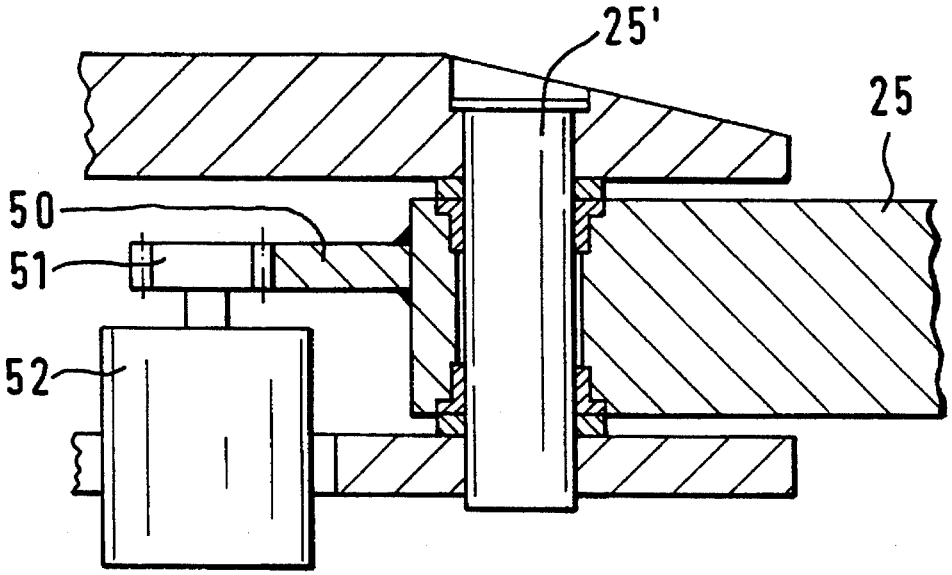
FIG. 6B shows an enlarged view of detail A in FIG. 6A.
Figure 7B:
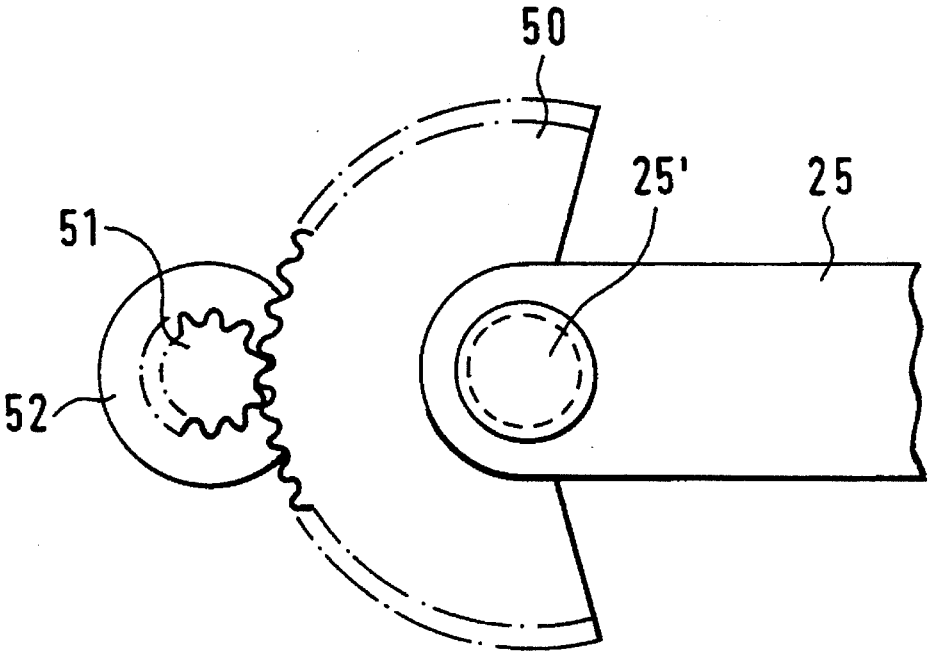
FIG. 7B shows an enlarged view of detail B in FIG. 7A.

FIGS. 6A and 7A illustrate the embodiment of the traction arrangement in which a horizontal beam or equivalent steering rod 25 is used in association with the tow arc 23. The eyelet is connected to the beam 25 which is movable in the tow arc 23. Means may be provided for rotating the horizontal beam 25 around a swivel point 25' (a shaft) so that the eyelet 24 can be shifted to a point where the tow rope 21 can easily pass through the eyelet 24. There are several ways to achieve this rotation of the beam 25. For example, as shown in FIGS. 6B and 7B, the rotating means may comprise a arcuate toothed rim 50 formed on an end of the horizontal beam 25 and a gearwheel 51 arranged in toothed engagement with the toothed rim 50. A motor 52 is arranged to rotate the gearwheel 51 and thus the toothed rim 50 of the beam 25. The beam 25 is thus turned around its swivel point 25' when the motor 52 is actuated.

Figure 6C:
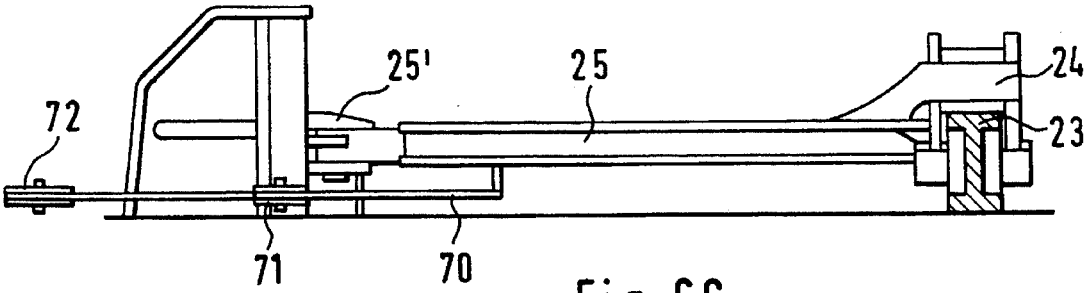
FIG. 6C shows a side view of another embodiment of the traction arrangement in accordance with the invention in which a horizontal beam or equivalent steering rod is used in association with the tow arc.
Figure 7C:
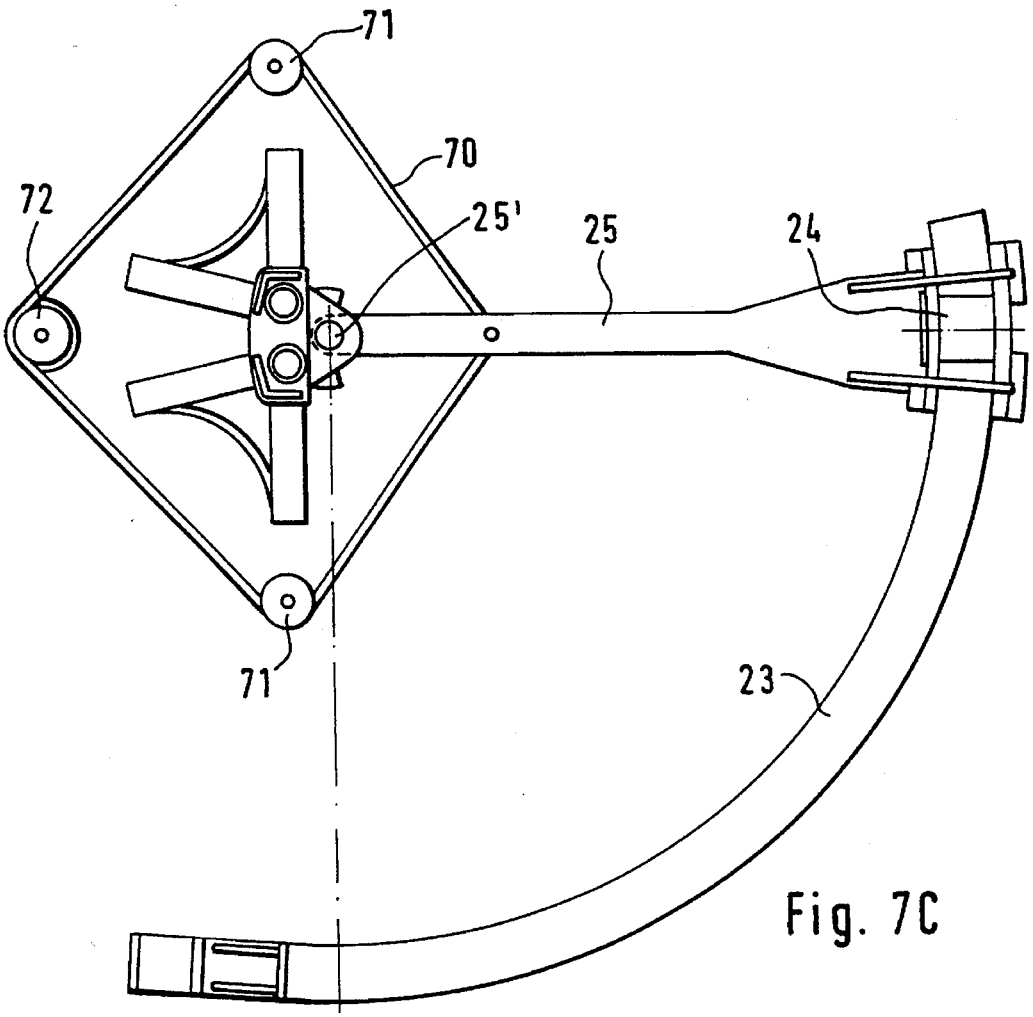
FIG. 7C shows a top view of the embodiment of the traction arrangement in accordance with the invention as shown in FIG. 6C.

FIGS. 6C and 7C illustrate another embodiment for providing rotational force to the beam 25. In this embodiment, the rotating means comprise a loop of wire rope 70 connected at one part to the beam 25 and running over a drive roller 72 and guide rollers 71. The drive roller 72 is connected to a rotating device, e.g., a hydraulic motor (not shown). When the drive roller 72 rotates, the beam 25 turns around its swivel point 25' in a desired manner.

Figure 6D:
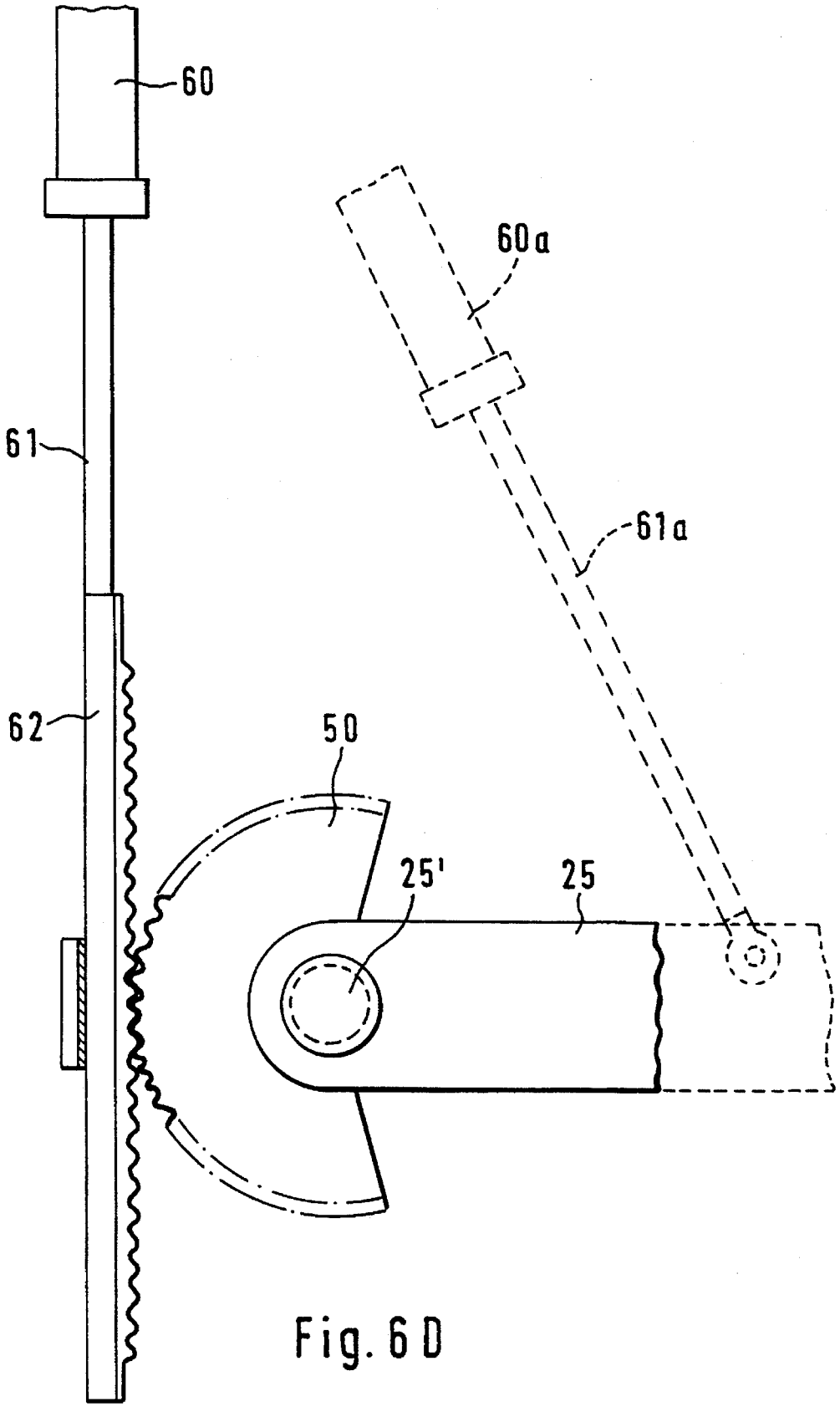
FIG. 6D shows a top view of still another embodiment of the traction arrangement in accordance with the invention in which a horizontal beam or equivalent steering rod is used in association with the tow arc.

FIG. 6D illustrates an alternative embodiment for providing rotational force to the beam 25. In this embodiment, the rotating means comprise a hydraulic cylinder 60 coupled to the beam 25 via a piston 61 of the cylinder 60 having a toothed rack 61 connected thereto. The toothed rack 62 is in toothed engagement with the toothed rim 50 of the beam 25. Alternatively, instead of the toothed engagement 50,62, it is possible to connect hydraulic cylinders directly to the beam. Cylinder 60*a* shown in dashed lines is thus coupled to the beam 25 through a piston 61*a* shown in dashed lines such that actuation of the cylinder causes movement of the beam 25 along the tow arc 23. It is also possible to couple one cylinder on each side of the beam 25.

Figure 8:
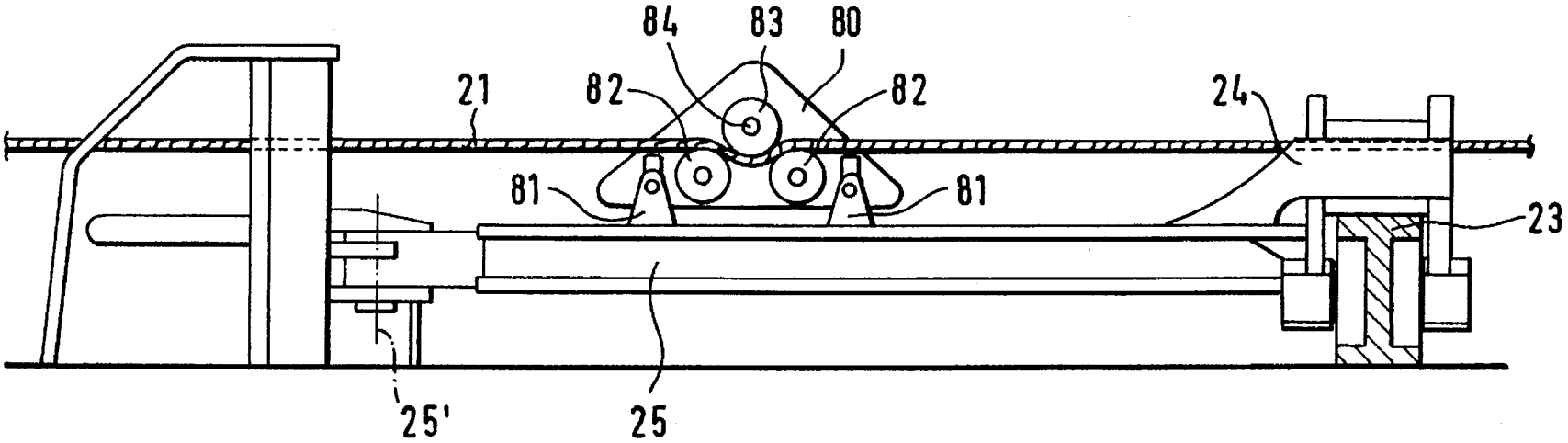
FIG. 8 shows an apparatus used to measure the traction power of the tow rope in the traction arrangement in accordance with the invention.

A roller arrangement or equivalent measurement tools for measuring the traction power of the tow rope 21 can readily be arranged in connection therewith. For example, FIG. 8 illustrates a floating type three-wheel-block 80 mounted on the horizontal beam 25 with lugs 81 in a floating manner. There are three wheels or rollers 82,83 in the block 80 arranged so that the tow rope 21 passes between roller 83 and each roller 82. Two of the rollers 82 are support rollers and the third roller 83 is a measurement roller having a tension measuring pin 84 of a strain gauge type. Other apparatus for measuring the traction power of the tow rope 21 may also be applied.

The examples provided above are not meant to be exclusive. Many other variations of the present invention would be obvious to those skilled in the art, and are contemplated to be within the scope of the appended claims.

I claim:

1. Traction arrangement for a tug boat having a towing winch mounted on a forecastle of the tug boat behind a transverse bulwark or in front of a transverse bulwark on an aft deck and a tow rope or towing wire connected to the towing winch and connectable to a vessel to be assisted by the tug boat, comprising a substantially arcuate tow arc mounted on the deck and arranged in a plane substantially parallel to a plane of the deck, a towing eyelet movable along said tow arc, the tow rope or towing wire being passed from the towing winch through said towing eyelet for connection to the vessel being assisted, said towing eyelet being movable along said tow arc to different angular positions in relation to a towing angle defined between a longitudinal center line of the boat and a direction of the tow rope or towing wire extending from the boat to the vessel, and a steering runner through which the tow rope or towing wire passes from the towing winch to said towing eyelet, said steering runner being arranged substantially within an area of a centerpoint of said tow arc.

2. The traction arrangement of claim 1, wherein said towing winch is arranged in front of the transverse bulwark on said aft deck of the boat and said tow arc is situated in a stern part of said aft deck.

3. The traction arrangement of claim 1, wherein said towing winch is arranged on said forecastle of the tug boat behind the transverse bulwark and said tow arc is situated in front of said forecastle.

4. The traction arrangement of claim 1, wherein said tow arc comprises a tubular or rail construction and said towing eyelet is arranged in a slide or sledge engaging with and movable along said tubular or rail construction.

5. The traction arrangement of claim 1, wherein the towing winch is arranged substantially in an area of the centerpoint of said tow arc.

6. The traction arrangement of claim 1, wherein a region is defined between a bulwark of the boat and an end of the boat to which the bulwark does not extend, said tow arc being positioned in said region.

7. The traction arrangement of claim 1, wherein said tow arc is movable in order to pass the tow rope through said towing eyelet.

8. The traction arrangement of claim 1, further comprising a vertical shaft positioned in the centerpoint of said tow arc, said steering runner being arranged on said vertical shaft, and a horizontal beam connected to said vertical shaft and said towing eyelet for coupling said vertical shaft to said towing eyelet.

9. The traction arrangement of claim 8, further comprising measurement means for measuring the traction power of the tow rope, said means being coupled to said horizontal beam.

10. The traction arrangement of claim 9, wherein said measurement means comprise a block mounted on said horizontal beam, said block having a plurality of rollers through which the tow rope passes and a tension measuring instrument coupled to one of said rollers.

11. The traction arrangement of claim 8, further comprising means for moving said towing eyelet along said tow arc, said means comprising an arcuate toothed rim coupled to said horizontal beam, a motor for providing motive power and a toothed gearwheel coupled to said motor and engaging with said toothed rim coupled to sad horizontal beam such that upon rotation of said gearwheel via said motor, said toothed rim is rotated causing rotation of said horizontal beam.

12. The traction arrangement of claim 8, further comprising means for moving said towing eyelet along said tow arc, said means comprising an arcuate toothed rim coupled to said horizontal beam, a hydraulic actuation cylinder, a piston actuated by said cylinder, a toothed rack connected to said piston and engaging with said toothed rim of said horizontal beam such that upon actuation of said piston, said toothed rack is moved and thus said toothed rim is rotated causing rotation of said horizontal beam.

13. The traction arrangement of claim 8, further comprising means for moving said towing eyelet along said tow arc, said means comprising at least one hydraulic actuation cylinder having a piston actuated by said cylinder connected to said horizontal beam such that upon actuation of said piston, said horizontal beam is moved.

14. The tug boat of claim 1, wherein the towing winch and said tow arc are stationarily, fixedly mounted to the deck.

15. The tug boat of claim 1, wherein said tow arc has a first end mounted to a first side of the deck of the boat and a second end mounted to a second side of the deck of the boat, said towing eyelet being movable about a center of curvature of said tow arc between said first and second ends to enable the tow rope to extend over both said first and second sides of the boat.

16. Traction arrangement for a tug boat having a towing winch mounted on a forecastle of the tug boat behind a transverse bulwark or in front of a transverse bulwark on an aft deck and a tow rope or towing wire connected to the towing winch and connectable to a vessel to be assisted by the tug boat, comprising a tow arc mounted on the deck, a towing eyelet movable along said tow arc, the tow rope being passed from the towing winch through said towing eyelet for connection to the vessel being assisted, said towing eyelet being movable along said tow arc to different angular positions in relation to a towing angle defined between a longitudinal center line of the boat and a direction of the tow rope extending from the boat to the vessel, and a steering runner through which the tow rope or towing wire passes from the towing winch to said towing eyelet, said steering runner being arranged substantially within an area of a centerpoint of said tow arc.

17. Traction arrangement for a tug boat having a towing winch arranged on a deck thereof and a tow rope or towing wire connected to the towing winch and connectable to a vessel to be assisted by the tug boat, comprising a substantially arcuate tow arc mounted on the deck and having a centerpoint, a towing eyelet movable along said tow arc, the tow rope being passed from the towing winch through said towing eyelet for connection to the vessel being assisted, said towing eyelet being movable along said tow arc to different angular positions in relation to a towing angle defined between a longitudinal center line of the boat and a direction of the tow rope extending from the boat to the vessel, a vertical shaft positioned in the centerpoint of said tow arc, a steering runner arranged on said vertical shaft and through which the tow rope passes, and a horizontal beam connected to said vertical shaft and said towing eyelet for coupling said vertical shaft to said towing eyelet.

* * * * *